US007257938B2

(12) United States Patent
Wassenhoven

(10) Patent No.: US 7,257,938 B2
(45) Date of Patent: Aug. 21, 2007

(54) OPENING ROLLER ASSEMBLY FOR AN OPEN-END SPINNING MACHINE

(75) Inventor: Heinz-Georg Wassenhoven, Mönchengladbach (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 11/344,343

(22) Filed: Jan. 31, 2006

(65) Prior Publication Data

US 2006/0123766 A1 Jun. 15, 2006

Related U.S. Application Data

(63) Continuation of application No. PCT/EP2004/006210, filed on Jun. 9, 2004.

(30) Foreign Application Priority Data

Aug. 23, 2003 (DE) ..... 103 38 842
Aug. 23, 2003 (DE) ..... 103 38 901

(51) Int. Cl.
*D01H 4/08* (2006.01)

(52) U.S. Cl. ..... 57/412

(58) Field of Classification Search ..... 57/404–417
See application file for complete search history.

(56) References Cited

U.S. PATENT DOCUMENTS 4,296,527 A 10/1981 Eadie
4,519,205 A * 5/1985 Gubler ..... 57/406
4,633,664 A * 1/1987 Mueller-Storz et al. ..... 57/406
4,679,390 A 7/1987 Stewart
4,875,334 A * 10/1989 Rajsigl et al. ..... 57/406
4,894,983 A 1/1990 Schmid
5,850,730 A 12/1998 Wassenhoven et al.
6,691,502 B2 2/2004 Wassenhoven
2002/0033013 A1 3/2002 Wassenhoven
2003/0221407 A1* 12/2003 Landolt et al. ..... 57/408

FOREIGN PATENT DOCUMENTS

DE 24 41 846 A 3/1976
DE 35 43 428 A1 6/1987
DE 40 36 017 7/1991
DE 196 50 597 A1 6/1998
DE 100 54 697 A1 5/2002
EP 1 188 850 A 3/2002

* cited by examiner

*Primary Examiner*—Shaun R. Hurley
(74) *Attorney, Agent, or Firm*—Alston & Bird LLP

(57) ABSTRACT

An opening roller assembly for an open-end spinning device of a textile machine, wherein an opening roller (12) is mounted on a bearing shaft (17) which is fixed in a bearing bracket (14) of an opening roller housing (11) in such a manner that the shaft can be easily removed. A drive (28) for rotating the opening roller is provided by a single electrical motor formed as an external rotor. A contact lead device (18) is mounted on the bearing shaft and includes leads (19) which are connected to the electrical motor, and a contact shoe housing (50) is provided which includes contact shoes or contact pins (21) which are connected to a power supply (27) of a corresponding textile machine and which can be selectively brought into contact with the leads (19) of the contact lead device (18).

17 Claims, 6 Drawing Sheets

OPENING ROLLER ASSEMBLY FOR AN OPEN-END SPINNING MACHINE

CROSS REFERENCE TO RELATED APPLICATION

The present application is a continuation of international application PCT/EP2004/006210, filed 9 Jun., 2004, and which designates the U.S. The disclosure of the referenced application is incorporated herein by reference.

BACKGROUND OF THE INVENTION

The invention relates to an open-end spinning machine of the type having a stationary rotor housing which mounts a rotating rotor cup and a sliver opening unit which includes an opening roller assembly.

In connection with open-end spinning machines e.g. of rotor spinning machines, different embodiments of opening rollers are known.

In DE 35 43 428 A1, for example, an opening roller is described which comprises a bearing shaft at its rear side and is mounted with this bearing shaft in the bearing bracket of an opening roller housing. The bearing shaft has on its end a so-called drive whorl which is driven by a tangential belt having the same length as the machine and which is connected via a shaft to the base plate of the opening roller. On the opening roller's base plate mounted in such a manner that it can rotate, a so-called trimming ring is fixed in such a manner that it can be replaced. To replace the trimming ring the opening roller can be pivoted away from the tangential belt and subsequently dismounted from the opening roller housing at the front.

Furthermore, for example, opening rollers which are driven by a single motor are also known from DE 40 36 017 A1 or DE 100 54 697 A1. Such opening roller drives are formed as external rotors which are fixed by their stator to the opening roller housing and connected via the electric lines to the power supply of the textile machine. On this external rotor a trimming ring is also disposed in such a manner that it can be replaced.

However, it is disadvantageous in the case of these opening rollers driven by a single motor that to replace the trimming ring the drive of the opening roller must also be dismounted and in so doing electric lines or corresponding plug-in connectors must be disconnected. On re-mounting of the opening roller these plug-in connectors must then be carefully connected once again. The mounting and dismounting of opening rollers of this type thus prove to be relatively complicated and time-consuming.

Finally, in DE 196 50 597 and corresponding U.S. Pat. No. 5,850,730 an open-end spinning device is described whose opening roller with its bearing shaft is mounted in the bearing bracket of an opening roller housing and comprises a single drive formed as an external rotor. On the end of the bearing shaft of this opening roller a whorl is disposed which can be acted on by a brake element. The known opening roller is fixed in the bearing bracket by a spring wire which engages in an annular groove of the bearing shaft. Furthermore, a locking and unlocking device is present which can be actuated by a toggle switch disposed in front of the opening roller housing, said toggle switch being connected via a shaft to connecting links toward the rear. That is, by means of the toggle switch, connecting links which comprise different switching surfaces can be turned so that the brake is pressed onto the whorl and at the same time the power supply of the opening roller drive is interrupted. In an additional switching position the arresting of the bearing shaft of the opening roller in the bearing bracket can be discontinued and the brake once again released.

Also in the case of this known opening roller, as described above, in dismounting and mounting of the opening roller plug-in contacts must first be disconnected in a laborious and time-consuming manner and later connected once again.

Proceeding from the aforementioned state of the art, the objective of the invention is to provide an opening roller which is driven by a single motor but, e.g. for replacing a trimming ring, can be mounted and dismounted from its bearing bracket on the opening roller housing securely and without difficulty.

SUMMARY OF THE INVENTION

The above and other objects and advantages of the invention are achieved by the provision of an opening roller assembly which includes an opening roller housing which is pivotally mounted to the frame of the spinning machine and which includes a bearing bracket which removably mounts a bearing shaft. An opening roller is mounted on one end of the shaft, and a drive which includes a single electrical motor having an external rotor serves to rotatably drive the opening roller. The bearing shaft also mounts a contact lead device which has leads for engaging contact shoes or pins in a contact shoe housing, and by which power is delivered to the electric motor.

The configuration according to the invention of an opening roller with a contact lead device in the area of its bearing shaft, and which engages contact shoes or contact pins, has in particular the advantage that, although an opening roller driven by a single motor is used, in dismounting of the opening roller, as is necessary in connection with the replacement of the trimming ring, no electric plug-in contacts or the like have to be disconnected and on subsequent mounting connected once again. Through the contact lead device according to the invention, it is moreover ensured that the drive of the opening roller in its dismounting can be decoupled from the power supply of the respective textile machine without difficulty and on mounting can also be coupled once again in a simple manner.

The contact lead device comprises in an advantageous embodiment several electrically separated contact leads. Due to the plurality of contact leads disposed in such a manner that they are electrically separated, it is possible in connection with corresponding contact shoes or contact pins to transmit electrical power as well as signals from the control electronics to the drive via the contact lead device.

The contact lead device advantageously comprises in the area of the free end of the bearing shaft of the opening roller a contract zone in which the contact leads are formed as a ring. That is, the contact leads extend completely around the bearing shaft of the opening roller in the area of the contact zone. In connection with corresponding stationary contact shoes or contact pins it is ensured by such a configuration that independently of the particular angular position of the opening roller, after it is mounted, contact in accordance with specifications between the contact shoes or contact pins and the contact leads is always ensured and thus a secure power supply and signal supply is ensured.

It is furthermore provided in a preferred embodiment to dispose the contact lead device in or on a plastic element which, for example, can be fixed on the bearing shaft of the opening roller by a clip connection. The relatively sensitive contact lead device is thereby most extensively protected against external mechanical impacts.

It is furthermore provided that the contact lead device in the mounted state of the opening roller projects into a contact shoe housing so that the contact leads correspond to matching contact shoes or contact pins in accordance with specifications and thus a reliable power supply and signal supply of the opening roller drive is ensured.

If necessary, it is possible without difficulty to switch the contact shoe housing by a simple radial displacement from a first operating position in which the contact shoes or contact pins engage with the matching contact leads into a second operating position in which the contact shoes or contact pins do not engage with the matching contact leads and thus the drive of the opening roller is disconnected from the power source. That is, in the first operating position proper operation of the opening roller is possible while in the second operating position the opening roller can be taken out of the opening roller housing at the front without difficulty and, for example, can be replaced by a new or reconditioned opening roller, e.g. provided with a new trimming ring. In the course of the mounting or dismounting of the opening roller, no electrical plug-in contacts or the like have to be disconnected and connected once again.

As a consequence, the above configuration ensures not only that during the spinning operation there is always a secure electrical connection to the opening roller drive, but it is also ensured that if necessary the drive of the opening roller is reliably disconnected from the power supply.

In an advantageous embodiment, the contact shoe housing is fixed on a spring element, preferably a leaf spring. In this case, the spring element lies, with prestress, on the end side of a switching cam which is mounted in such a manner that it can be turned and comprises several switching surfaces of different heights. That is, by simply pivoting the switching cam the contact shoe housing can be displaced in the radial direction with respect to the bearing shaft of the opening roller and thus with respect to the corresponding contact leads.

The switching cam can advantageously be actuated via a toggle switch which is disposed in the area of the opening roller housing in such a that it is easily accessible. The good accessibility of the toggle switch makes an easy and quick change of the desired operating position possible for the operating personnel. A fixation element of a locking and unlocking device is also provided and which is controlled simultaneously with the contact shoe housing via the switching cam. This permits a problem free, completely uncomplicated change of the opening roller if necessary.

Preferably the locking and unlocking device comprises as its fixation element a torsion rod spring which is compressed in a first operating position in an arresting ring fixed on the bearing shaft of the opening roller. By mechanical action, the torsion rod spring secures the bearing shaft of the opening roller not only against displacement in the axial direction but rather also prevents the bearing shaft from being able to turn under the action of the torque of the opening roller drive.

In order to prevent the locking and unlocking device of the opening roller from being inadvertently released or the contact shoe housing unintentionally being changed over into the second operating position described above during the spinning operation, the open-end spinning device comprises a stationary stop. When the spinning device is closed, this stationary stop engages over the leaf spring lying on the switching cam and bearing the contact shoe housing. That is, the stationary stop prevents the toggle switch from pivoting and thus the contact shoe housing and the fixation element from being able to change over into an operating position in which operation of the opening roller according to specifications is no longer ensured. The stationary stop furthermore makes it impossible to close the spinning device if the switching cam is in an operating position in which the contact shoes do not touch the contact leads and the locking and unlocking device does not arrest the bearing shaft of the opening roller.

The contact lead device can, for example, be made of a conductive foil which after cutting is preferably fixed on a plastic supporting element. The plastic supporting element is then fixed by means of a suitable connection mechanism, e.g. via a clip connection, to the bearing shaft of the opening roller.

That is, the supporting element provided with a conductive foil is reliably connected to the bearing shaft of the opening roller via the clip connection as well as a corresponding counter bearing.

BRIEF DESCRIPTION OF THE DRAWINGS

The invention is described in more detail in the following, with the aid of an exemplary embodiment represented in the drawings, in which.

DETAILED DESCRIPTION OF THE PREFERRED EMBODIMENTS

Figure 1:
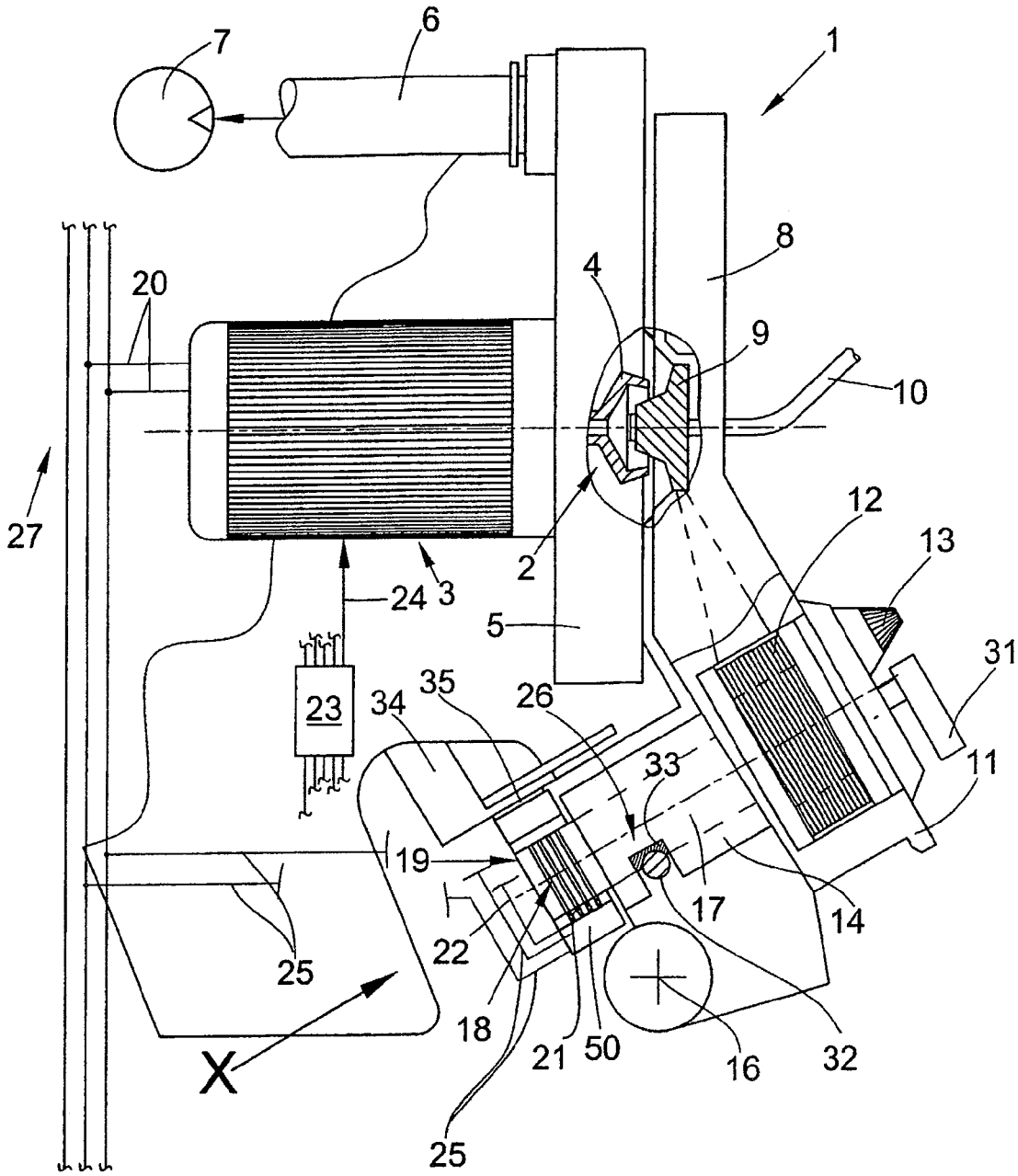
FIG. 1 is a schematic view of an open-end spinning machine with an opening roller which can be driven by a single motor and whose power supply comprises a contact lead device which can be decoupled.

FIG. 1 shows one of the numerous open-end spinning devices 1 of an open-end rotor spinning machine. Such open-end spinning devices 1 are known in principle and are described, for example, in DE 196 50 597 A1 in a relatively detailed manner.

As is known, open-end spinning devices 1 of this type have a spinning rotor 2 whose rotor cup 4 rotates at a high rotary speed in a rotor housing 5 during the spinning operation. The rotor housing 5, which is closed at the front by a cover element 8 during the spinning operation, is connected via a pneumatic line 6 to a low pressure source 7 which provides the low pressure in the rotor housing 5 necessary for spinning. The spinning rotor 2 can be driven in a defined manner by a single drive 3 powered by an electric motor, said drive, for example, being connected via electric lines 20 to the power supply 27 of the particular textile machine. For this purpose, the electromagnetic single drive 3 is connected in addition via at least one signal line 24 to corresponding control electronics 23.

The cover element 8 which closes the rotor housing 5 during the spinning operation is mounted in such a manner that it can pivot to a limited extent about a pivot axis 16 so that the idle spinning rotor 4 is accessible if necessary.

Introduced into the cover element 8 in addition, and in a manner such that it can be replaced, at the level of the spinning rotor 2 is a so-called channel plate adapter 9 to which a thread take-off tube 10 is connected. Furthermore, the cover element 8 comprises, as is customary, an opening roller housing 11 in which an opening roller 12 rotates. The opening roller 12 and its bearing shaft 17 is fixed in a rear-side bearing bracket 14 of the opening roller housing 11 and along with this is secured by a locking and unlocking device 26. The locking and unlocking device 26 consists of a spring element 32, preferably a torsion rod spring, which is compressed into an arresting ring 33 disposed on the bearing shaft 17 of the opening roller 12.

Figure 2:
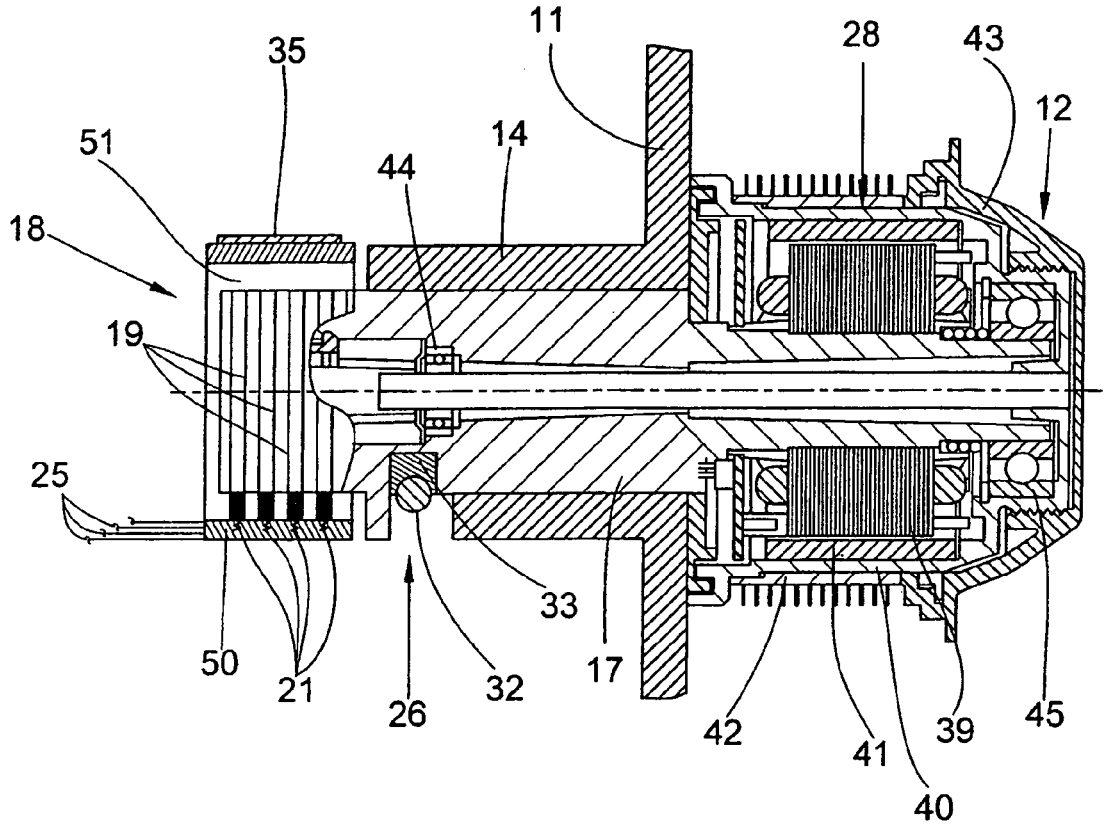
FIG. 2 is a cross sectional view of the opening roller which is fixed in a bearing bracket of an opening roller housing, and which is driven by a single motor, and comprises a contact lead device mounted in such a manner that it can be pivoted.
Figure 5:
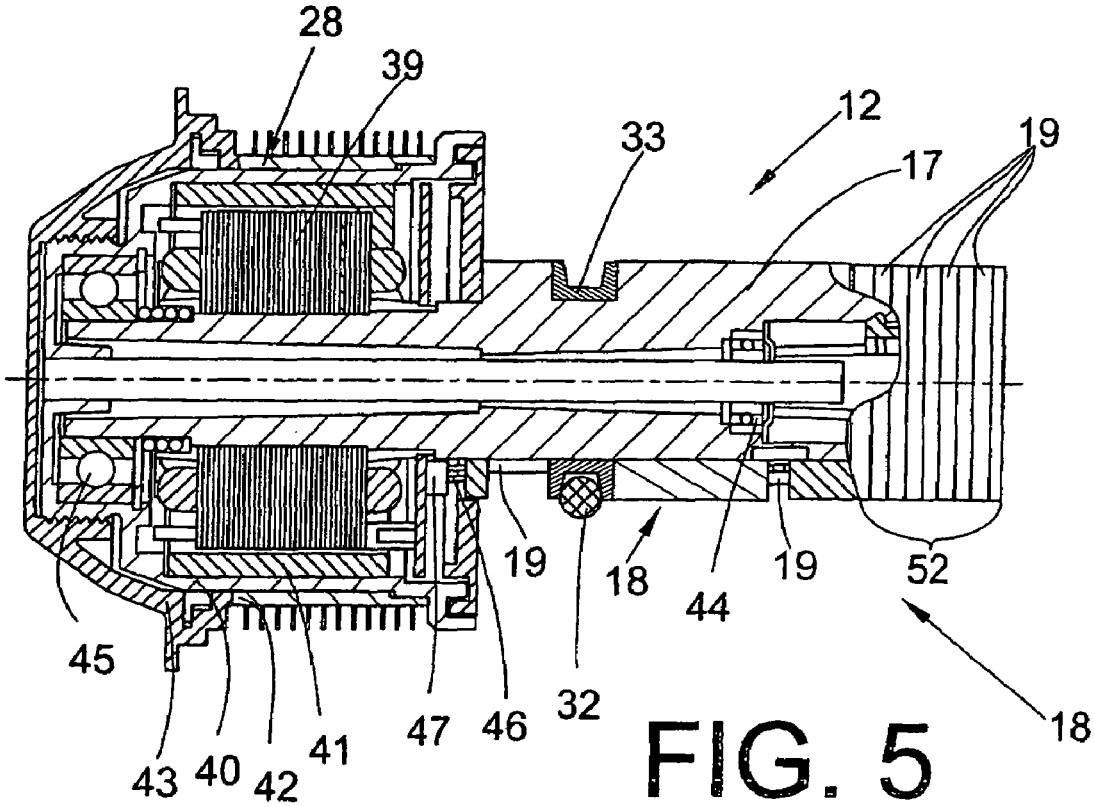
FIG. 5 is a partially sectioned view of an opening roller which is driven by a single motor and which includes a contact lead device.

As can be seen in particular from FIGS. 2 and 5, the opening roller 12 is driven by a single drive 28 which is powered by an electric motor, said drive being formed as an external rotor. The drive comprises in the end area of its bearing shaft 17 a contact lead device 18 which permits an easily removable coupling to a power supply and signal device 27 of the open-end rotor spinning machine. The contact lead device 18 consists in this case of several electrically separated contact leads 19 which are formed in a ring in the end area of the bearing shaft 17. The annular contact leads 19 correspond in the area of a contact zone 52 to contact shoes or contact pins 21 which can be provided with electrical power and are connected via electric lines 25 to the power supply and signal device 27 of the open-end rotor spinning machine or via a signal line 22 to a control device.

The contact shoes or pins 21 are disposed in such a manner that they are protected in a contact shoe housing 50 which, as will be explained in more detail later, is mounted in such a manner that it can be displaced in the radial direction with respect to the bearing shaft 17 of the opening roller 12. That is, the contact shoe housing 50 is, as can be seen in particular from FIGS. 3 and 4, fixed via a spring element 35, preferably a leaf spring, in such a manner that it can move to a limited extent on the housing of a drive 36 of the sliver intake cylinder 13. The leaf spring 35 bearing the contact shoe housing 50 as well as the torsion rod spring 32 serving as fixation element of the locking and unlocking device 26 lie in this case on switching surfaces 30A to 30D of a switching cam 29 which can be pivoted in a defined manner by a toggle switch 31 disposed in the area of the opening roller housing 11. That is, either a first operating position A (spinning position) or a second operating position B (mounting position) can be set in a defined manner by the toggle switch 31.

As further indicated in FIG. 1, a stationary stop 34 is provided in addition on the open-end spinning device 1, said stationary stop engaging over the spring element 35 when the spinning device is closed, thereby preventing the switching cam 29 from being able to be changed over from operating position A to operating position B by means of the toggle switch 31.

The opening roller 12 represented in FIGS. 2 and 5 approximately on the original scale comprises fixed as well as rotatable components. Among the fixed components in this case are the bearing shaft 17 with the contact lead device 18 as well as the stator winding 39 of the opening roller drive 28. The base plate 40 of the opening roller 12, which with its permanent magnets 41 disposed on the inner side forms the rotor of the opening roller drive 28, is supported on the bearing shaft 17 of the opening roller 12 in such a manner that it can be rotated via roller bearings 44 or 45. Disposed, as is known, on the base plate 41 is a replaceable trimming ring 42 which is secured by a so-called washer disk 43.

As represented in FIG. 2, the rear area of the fixed bearing shaft 17, which comprises annular contact leads 19, projects into an opening 51 of a contact shoe housing 50, which is also mounted in such a manner that it cannot rotate. Lying on the annular contact leads 19 in the operating position A are contact shoes or contact pins 21 disposed in the contact shoe housing 50, which in turn are connected via electrical lines 25 to the power supply 27 of the textile machine as well as a control device (not represented). Along with this, the opening 51 of the contact shoe housing 50 is formed so that, if necessary, a radial displacement of the contact shoe housing 50 with respect to the bearing shaft 17 of the opening roller 12 is possible.

Figure 3:
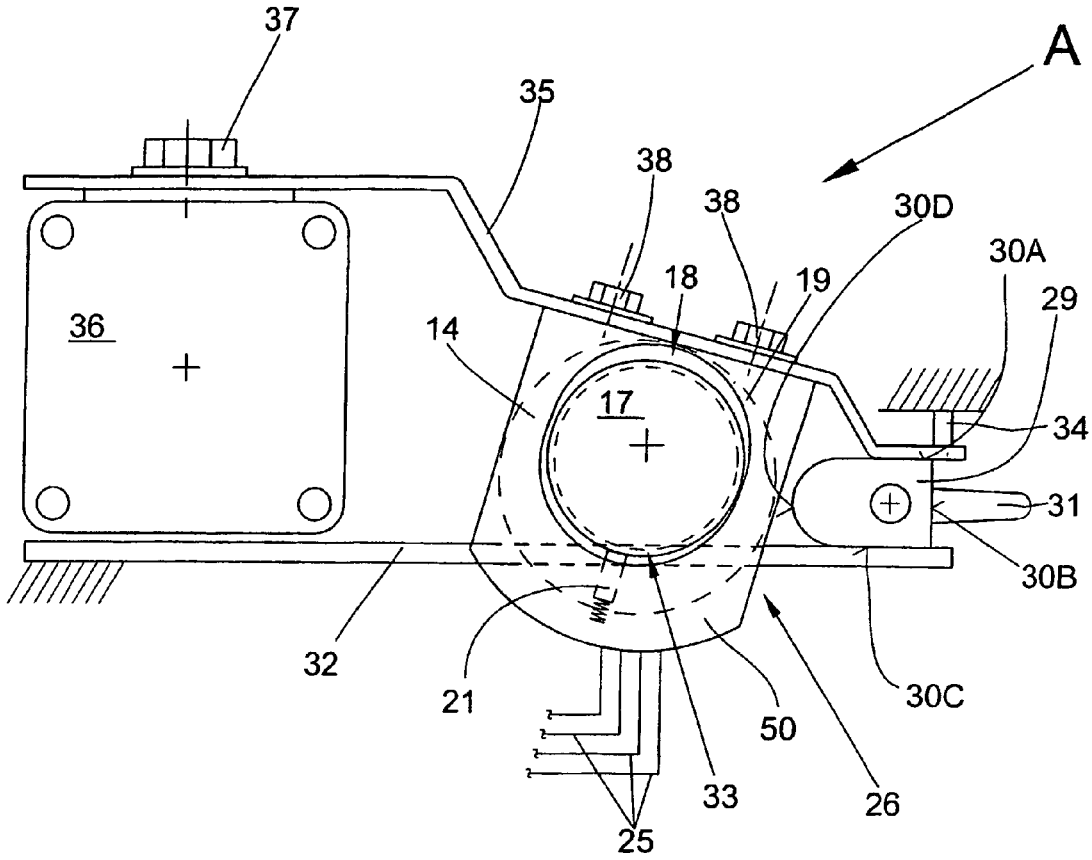
FIG. 3 shows the contact shoe housing encircling the contact lead device on the bearing shaft of the opening roller according to the arrow X indicating the direction of view in FIG. 1 in a first operating position.
Figure 4:
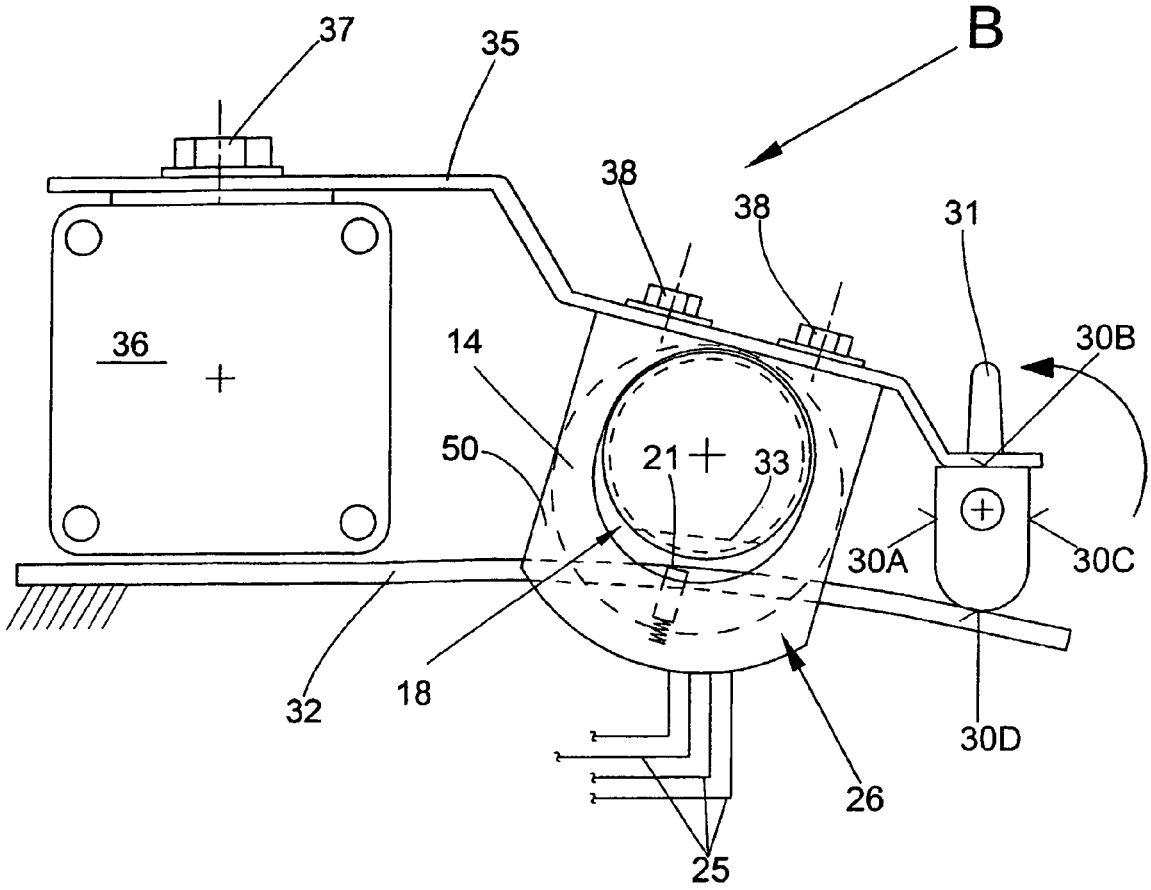
FIG. 4 is a view similar to FIG. 3 and shows the contact shoe housing in a second operating position.

As already indicated above, and as can be seen in particular from FIGS. 3 and 4, the contact shoe housing 50 is fixed via screw bolts 38 to a spring element, preferably a leaf spring 35, which in turn is fastened via screw bolts 37 to the housing of the drive 36 for the sliver intake cylinder 13. The leaf spring 35, bent twice in the illustrated embodiment, lies with its free end on a switching cam 29 which, by means of a toggle switch 31, can be switched between a first operating position A (spinning position) and a second operating position B (mounting position). Furthermore, a torsion rod spring 32 of the locking and unlocking device 26 lies on the switching cam 29, which comprises four switching surfaces 30A, 30B, 30C, and 30D which are each at different distances from the axis of rotation of the switching cam 29, said torsion rod spring fixing the bearing shaft 17 of the opening roller 12 in the bearing bracket 14 via an arresting ring 33.

Figure 6:
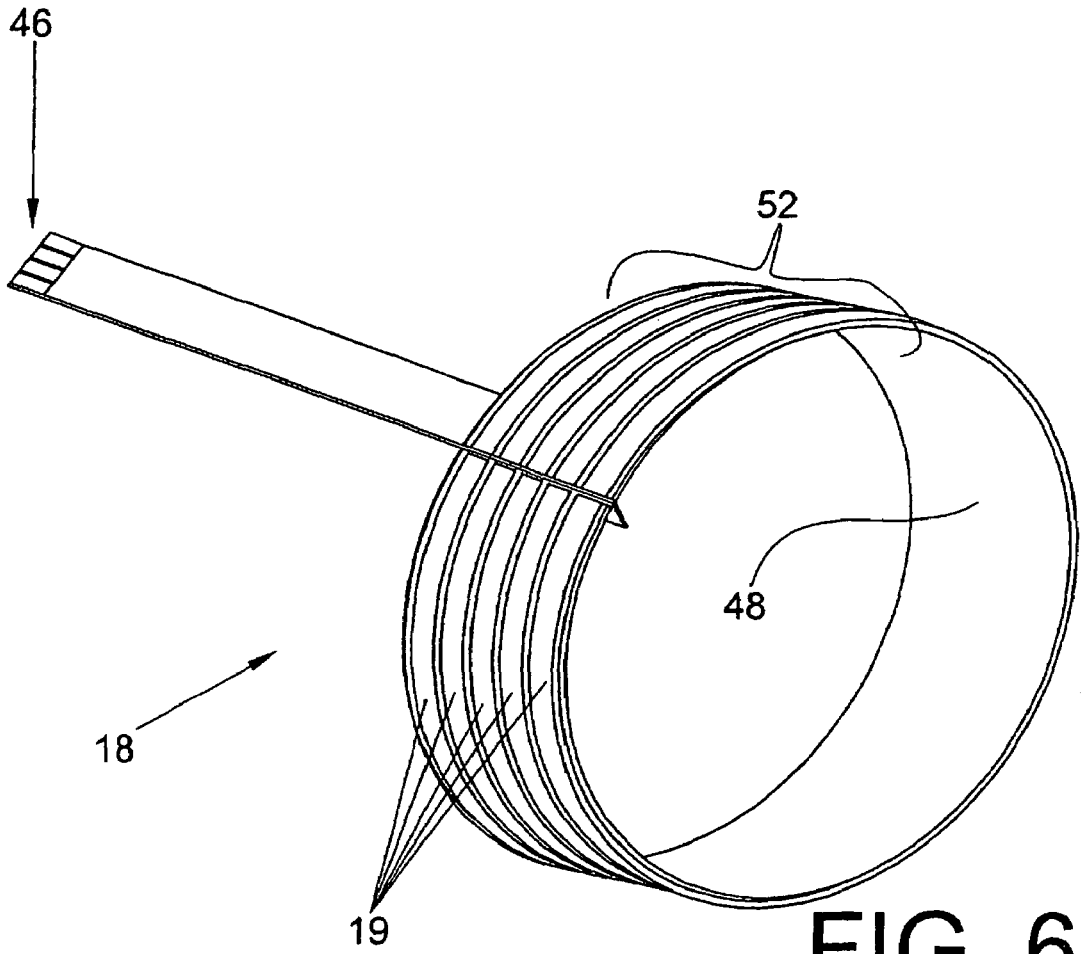
FIG. 6 shows a contact lead device made, for example, of conductive foil, before its mounting on the bearing shaft.

As indicated in FIG. 6, the contact lead device 18 consists essentially of a plastic supporting element 48, on or in which the electrically separated contact leads 19 are disposed which, for example, are made of a conductive foil. In this case, in the area of the contact zone 52 the contact leads 19 are formed in a ring and in this area match corresponding contact shoes or contact pins 21 in the contact shoe housing 50 (see FIG. 2). On the side opposite the contact zone 52 the contact leads 19 terminate in plug-in contacts 46 which engage in corresponding recesses 47 of the stator winding 39 of the opening roller drive 28. As indicated above, the contact leads 19 of the contact lead device 18 are, for example, made of a gold-plated conductive foil which, after cutting, is fastened, e.g. by an adhesive, to the supporting element 48.

Function of the Device

During the spinning operation the rotor housing 5 pressurized with low pressure is firmly closed by the cover element 8 and in so doing also locked so that it cannot be opened unintentionally. Along with this, the leaf spring 35, which bears the contact shoe housing 50, is positioned under a stationary stop 34 so that the toggle switch 31 cannot be pivoted. During the spinning operation the thread produced in the open-end spinning device 1 is taken off via the thread take-off tube 10 and in so doing continuously monitored by a sensor device (not represented). If a break in the thread occurs, which is immediately detected by the sensor device, the sensor device provides for the rotating functional members of the open-end spinning device 1 to be immediately braked or switched off. That is, the drive 3 of the spinning rotor 2 and the drive 28 of the opening roller 12 are energized with a braking current and braked to a stop. Furthermore, power to the drive 36 for the sliver intake cylinder is shut off. Along with this, the open-end spinning device 1 can only be opened if the spinning rotor 4 has nearly stopped. That is, the cover element 8 can only be pivoted downwards about the pivot axis 16 when the spinning members have stopped.

As already indicated above, during the spinning operation the toggle switch 31, via which the contact shoe housing 50 as well as the locking and unlocking device 26 can be pivoted, is in a first operating position A (FIG. 3) in which the leaf spring 35 is supported on the switching surface 30A of the switching cam 29 and the torsion rod spring 32 of the locking and unlocking device 26 lies on the supporting surface 30C. In the operating position A the contact shoe housing 50 is raised so far that the contact shoes or pins 21 lie securely on the annular contact leads 19 in the end area of the bearing shaft 17 of the opening roller 12 and thus the transmission of electrical power and/or of control signals to the drive 28 of the opening roller 12 is enabled. Furthermore, in the operating position A the torsion rod spring 32 is compressed in an arresting ring 33 on the bearing shaft 17 of the opening roller 12 and thus arrests the opening roller 12 in the bearing bracket 14.

On opening the spinning device, i.e. on pivoting down of the cover element 8 about the pivot axis 16, the leaf spring 35 is taken away from the area of action of the stop 34 so that the toggle switch 31 can then be changed over from the operating position A to the operating position B (FIG. 4). In so doing, the leaf spring 35 comes to lie on the switching surface 30B of the switching cam 29, which is at a smaller distance from the axis of rotation of the switching cam 29 than the switching surface 30A. The leaf spring 35, and thus also the contact shoe housing 50, are thereby lowered so far that the contact shoes or pins 21 go out of engagement with the contact leads 19 of the contact lead device 18 on the bearing shaft 17 of the opening roller 12.

On pivoting of the toggle switch 31, and thus of the switching cam 29, the switching surface 30D is simultaneously pivoted under the torsion rod spring 32. Since the distance of the switching surface 30D from the axis of rotation of the switching cam 29 is greater than the distance of the switching surface 30C from said axis, the torsion rod spring 32 is pressed downwards and in so doing slides out of the recess of the arresting ring 33 fixed on the bearing shaft 17 of the opening roller 12. The opening roller 12 can then be dismounted from the opening roller housing 11 at the front without difficulty and replaced by a new or a repaired one, e.g. by an opening roller 12 provided with a new trimming ring 42.

The mounting of the new or a repaired opening roller 12 is just as simple as the above described dismounting of the opening roller 12. It is merely done in reverse order.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An opening roller assembly for an open-end spinning machine, comprising an opening roller housing which is pivotally mounted to the frame of the spinning machine and which includes a bearing bracket, a bearing shaft removably mounted in the bearing bracket, an opening roller mounted on the bearing shaft and within the opening roller housing, a drive for rotating the opening roller and which comprises a single electrical motor mounted on the bearing shaft and having an external rotor, and a contact lead device mounted on the bearing shaft and including contact leads which are electrically connected to the single electrical motor and for engaging contact shoes or contact pins which are connected to a power supply of the spinning machine.

2. The opening roller assembly according to claim 1, wherein the contact leads of the contact lead device comprise several electrically separated contact leads.

3. The opening roller assembly according to claim 2, wherein the contact leads of the contact lead device are disposed in a contact zone in an area adjacent a free end of the bearing shaft.

4. The opening roller assembly according to claim 3, wherein the contact leads of the contact lead device are in the form of rings disposed on or in an annular supporting element which surrounds the free end of the bearing shaft.

5. The opening roller assembly according to claim 1, wherein the contact shoes or contact pins are configured for the transmission of electrical operating power as well as for the transmission of control signals.

6. The opening roller assembly according to claim 1, wherein the contact lead device in the mounted state of the opening roller projects into a contact shoe housing in such a manner that the contact leads correspond to matching contact shoes or pins which are disposed within the contact shoe housing.

7. The opening roller assembly according to claim 6, wherein the contact shoe housing is mounted in such a manner that it can be selectively displaced in a radial direction with respect to the bearing shaft between a first operating position (A) in which the contact leads of the contact lead device are in contact with the matching contact shoes or pins, and a second operating position (B) in which the contact leads are not in contact with the matching contact shoes or pins.

8. The opening roller assembly according to claim 7, wherein the contact shoe housing is fixed on a spring element, wherein said spring element lies, with prestress, on a switching cam which comprises several switching surfaces of different heights and which is mounted in such a manner that it can be rotated.

9. The opening roller assembly according to claim 8, wherein a toggle switch is disposed in the area of the opening roller housing which makes it possible to rotate the switching cam so as to displace the contact shoe housing between the first operating position (A) and the second operating position (B).

10. The opening roller assembly according to claim 9 further comprising a fixation element positioned for movement between a locking position in engagement with an arresting ring on the bearing shaft and wherein the bearing shaft is locked in the bearing bracket of the opening roller housing, and a released position wherein the fixation device is out of engagement with the arresting ring and the bearing shaft may be axially removed from the bearing bracket.

11. The opening roller assembly according to claim 10, wherein the toggle switch is positioned to move the fixation element to the locking position when the contact shoe housing is in the first operating position (A) and to the released position when the contact shoe housing is in the second operating position (B).

12. The opening roller assembly according to claim 11, wherein the switching cam is formed so that the contact shoe housing and the fixation element can be displaced simultaneously by respective switching surfaces on the cam.

13. The opening roller assembly according to claim 10, wherein the fixation element is formed as a torsion rod spring which in the first operating position (A) lies in the arresting ring on the bearing shaft and secures the opening roller in the bearing bracket in the axial direction.

14. The opening roller assembly according to claim 9, wherein the opening roller housing is pivotally mounted for movement between open and closed positions, and further comprising a stationary stop mounted to the frame of the spinning machine which in the closed position engages the spring element which bears the contact shoe housing and prevents the toggle switch from being able to rotate from the first operating position (A) into the second operating position (B).

15. The opening roller assembly according to claim 1 wherein the single electrical motor comprises said external rotor and a stator winding fixedly mounted on the bearing shaft, with the external rotor surrounding the stator winding and being rotatably mounted to the bearing shaft.

16. The opening roller assembly according to claim 15 wherein the contact leads of the contact lead device are electrically connected to the stator winding.

17. The opening roller assembly according to claim 16 wherein the contact shoes or contact pins are mounted in a contact shoe housing which surrounds the contact lead device on the bearing shaft and is radially moveable between a first operating position (A) in which the contact leads of the contact lead device are in contact with matching shoes or pins, and a second operating position (B) in which the contact leads are separated from the matching shoes or pins, whereby the bearing shaft can be readily axially removed from the bearing bracket and the contact shoe housing when the contact shoe housing is moved to the second operating position (B).

* * * * *